US010837616B2

(12) United States Patent
Kaneko

(10) Patent No.: US 10,837,616 B2
(45) Date of Patent: Nov. 17, 2020

(54) VEHICLE LAMP

(71) Applicant: Koito Manufacturing Co., Ltd., Tokyo (JP)

(72) Inventor: Yuya Kaneko, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/676,658

(22) Filed: Nov. 7, 2019

(65) Prior Publication Data

US 2020/0149703 A1 May 14, 2020

(30) Foreign Application Priority Data

Nov. 9, 2018 (JP) ..... 2018-211136

(51) Int. Cl.
*F21S 43/145* (2018.01)
*F21S 43/50* (2018.01)
*F21S 43/19* (2018.01)

(52) U.S. Cl.
CPC ..... *F21S 43/145* (2018.01); *F21S 43/195* (2018.01); *F21S 43/50* (2018.01)

(58) Field of Classification Search
CPC ..... F21S 43/145; F21S 43/50; F21S 43/195
USPC ..... 362/546
See application file for complete search history.

(56) References Cited

U.S. PATENT DOCUMENTS 6,604,834 B2 * 8/2003 Kalana ..... B60Q 1/30 362/84
8,292,480 B2 * 10/2012 Koizumi ..... B60Q 1/2607 362/545
10,458,618 B2 * 10/2019 Gloss ..... F21S 43/315
2002/0163796 A1 * 11/2002 Dickie ..... H05B 33/00 362/84
2003/0231487 A1 * 12/2003 Chien ..... A42B 1/242 362/84
2008/0225537 A1 * 9/2008 Tronquet ..... F21V 29/15 362/487
2015/0023046 A1 * 1/2015 Shido ..... F21S 43/14 362/543
2015/0062946 A1 * 3/2015 Fukai ..... F21S 43/40 362/516
2015/0291085 A1 * 10/2015 Manning ..... F21S 43/14 362/516
2017/0284623 A1 * 10/2017 Willett ..... F21S 43/145
2017/0292672 A1 * 10/2017 Shido ..... B60Q 1/30

(Continued)

FOREIGN PATENT DOCUMENTS

JP 2017-208226 A 11/2017

*Primary Examiner* — Bryon T Gyllstrom
(74) *Attorney, Agent, or Firm* — Abelman, Frayne & Schwab

(57) ABSTRACT

A vehicle lamp includes a lamp outer case including a lamp housing having an opening and a cover configured to block the opening, an interior space of the lamp outer case being formed as a lamp chamber; a panel body including a holder in the lamp chamber and provided with an attached portion and a holding portion, and an organic electroluminescence panel held in the holding portion; and an attachment body disposed in the lamp chamber and attached with the panel body. The attachment body includes an attaching portion to which the attached portion is attached, and the panel body is attached to the attachment body in a cantilever state.

5 Claims, 10 Drawing Sheets

(56) References Cited

U.S. PATENT DOCUMENTS

| | | | | |
|---|---|---|---|---|
| 2017/0358773 | A1* | 12/2017 | Jaganathen | F21S 43/145 |
| 2019/0242546 | A1* | 8/2019 | Sakashita | F21S 43/237 |

* cited by examiner

VEHICLE LAMP

CROSS-REFERENCE TO RELATED APPLICATIONS

This application is based on and claims priority from Japanese Patent Application No. 2018-211136, filed on Nov. 9, 2018, with the Japan Patent Office, the disclosure of which is incorporated herein in its entirety by reference.

TECHNICAL FIELD

The present disclosure relates to a vehicle lamp including an organic electroluminescence panel.

BACKGROUND

There are vehicle lamps in which an organic electroluminescence (EL) panel is used as a light source (see, e.g., Japanese Patent Laid-Open Publication No. 2017-208226). The organic EL panel is a surface emitting self-emitting panel. Recently, the technology related to the organic EL panels has been improved, and progress has been made in developing vehicle lamps in which the organic EL panel is used as a light source.

Such an organic EL panel may be disposed in a lamp chamber, which is an interior space formed by a lamp housing and a cover, for example, in a state of being attached to an attachment body ("support member" in Japanese Patent Laid-Open Publication No. 2017-208226).

SUMMARY

As described above, in a vehicle lamp in which an organic EL panel is used as a light source, the organic EL panel is attached to an attaching portion of the attachment body. However, since the organic EL panel is a planar light source, the space occupied in the lamp chamber tends to be large, and accordingly, the size of the attaching portion tends to be large, as compared to other light sources such as a light emitting diode (LED).

Accordingly, the space occupied by the attaching portion in the lamp chamber may also increase, and light emitted from the organic EL panel may be reflected by the attaching portion, resulting in stray light, which may affect the light distribution control or increase the size of the vehicle lamp.

Hence, the present disclosure is to secure an appropriate light distribution state and to facilitate miniaturization.

First, a vehicle lamp according to the present disclosure includes: a lamp outer case including a lamp housing having an opening and a cover configured to block the opening, an interior space of the lamp outer case being formed as a lamp chamber; a panel body including a holding member disposed in the lamp chamber and provided with an attached portion and a holding portion, and an organic electroluminescence panel held in the holding portion; and an attachment body disposed in the lamp chamber and attached with the panel body. An attaching portion to which the attached portion is attached is provided in the attachment body. The panel body is attached to the attachment body in a cantilever state.

As a result, the panel body is attached to the attaching portion in a cantilever state. Thus, the size of the space occupied by the attaching portion in the lamp chamber may be reduced.

Second, in the vehicle lamp according to the present disclosure, it is desirable that the organic electroluminescence panel is connected with a connection line configured to supply a power, two attaching portions are provided apart from each other, a space between the two attaching portions is formed as an insertion space, and the connection line is inserted through the insertion space.

As a result, a part of the connection line connected to the organic electroluminescence panel is located between the two attaching portions. Thus, the space for disposing the connection line is effectively utilized and the connection line is hardly displaced due to vibration of the vehicle.

Third, in the vehicle lamp according to the present disclosure, it is desirable that the attachment body further includes a shielding portion configured to shield the attaching portion and the attached portion from the holding portion.

As a result, the attaching portion and the attached portion are shielded by the shielding portion and are not visually recognized. Thus, the light emitted from the organic electroluminescence panel is not reflected by the attaching portion or the attached portion.

Fourth, in the vehicle lamp according to the present disclosure, it is desirable that the organic electroluminescence panel is held in the holding portion in a state of being curved in a thickness direction.

As a result, light is emitted from the organic electroluminescence panel that is curved.

Fifth, in the vehicle lamp according to the present disclosure, it is desirable that at least a part of the organic electroluminescence panel is curved in a downward convex state.

As a result, there is a portion displaced upwardly in the front and rear direction, and it is possible to secure a sufficient viewing angle in the upward direction.

According to the present disclosure, since the panel body is attached to the attaching portion in a cantilever state, the size of the space occupied by the attaching portion in the lamp chamber may be reduced, and it is possible to secure an appropriate light distribution state and achieve miniaturization.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

In embodiments described below, a vehicle lamp according to the present disclosure is applied to a vehicle lamp such as, for example, a tail lamp disposed in a rear end portion of a vehicle body. In addition, the present disclosure may be widely applied to various vehicle lamps such as, for example, a head lamp, a tail lamp, a clearance lamp, a turn signal lamp, a stop lamp, a daytime running lamp, a cornering lamp, a hazard lamp, a position lamp, a back lamp, a fog lamp, or a combination lamp thereof.

In the following description, it is assumed that the front, rear, up, down, left, and right directions are indicated in a state where the vehicle lamp is disposed in a rear end portion of a vehicle body. However, the front, rear, up, down, left, and right directions described below are merely for convenience of explanation, and the embodiments according to the present disclosure are not limited to these directions. In addition, although an example of a vehicle lamp in which an organic electroluminescence panel is used as a light source is described below, the organic electroluminescence panel may also include an organic electroluminescence display which displays letters, figures, or the like.

<Overall Configuration of Vehicle Lamp>

Figure 1:
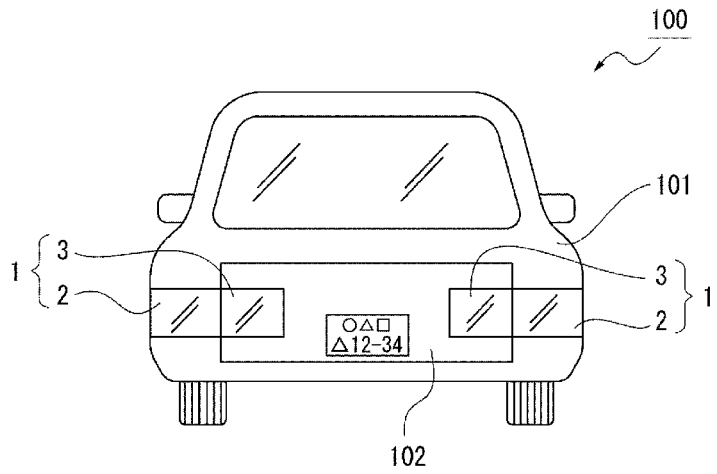
FIG. 1 illustrates an embodiment of a vehicle lamp according to the present disclosure together with FIGS. 2 to 14, and this figure is a rear view illustrating a state where a vehicle lamp is disposed in the vehicle body.

Vehicle lamps 1 and 1 are attached to, for example, both left and right end portions in a rear end portion of a vehicle body 100 (see FIG. 1), respectively. The vehicle lamp 1 includes, for example, a first lamp portion 2 disposed in a non-movable portion such as a main body portion 101 of the vehicle body 100 and a second lamp portion 3 disposed in a movable portion such as a trunk lid 102.

In the present disclosure, the vehicle lamp may be constituted only by the first lamp portion 2, or the vehicle lamp may be constituted only by the second lamp portion 3.

As described above, in the vehicle lamp 1, the first lamp portion 2 is disposed in the main body portion 101, the second lamp portion 3 is disposed in the trunk lid 102, and the first lamp portion 2 and the second lamp portion 3 are located adjacent to each other in a state where the trunk lid 102 is closed.

Although the example in which the first lamp portion 2 is disposed in the non-movable portion such as the main body portion 101, and the second lamp portion 3 is disposed in the movable portion such as the trunk lid 102 is described above, on the contrary, the first lamp portion 2 may be disposed in the movable portion such as the trunk lid 102, and the second lamp portion 3 may be disposed in the non-movable portion such as the main body portion 101. In addition, both the first lamp portion 2 and the second lamp portion 3 may be disposed in the movable portion, and both the first lamp portion 2 and the second lamp portion 3 may be disposed in the non-movable portion.

<Configuration of First Lamp Portion>

Figure 2:
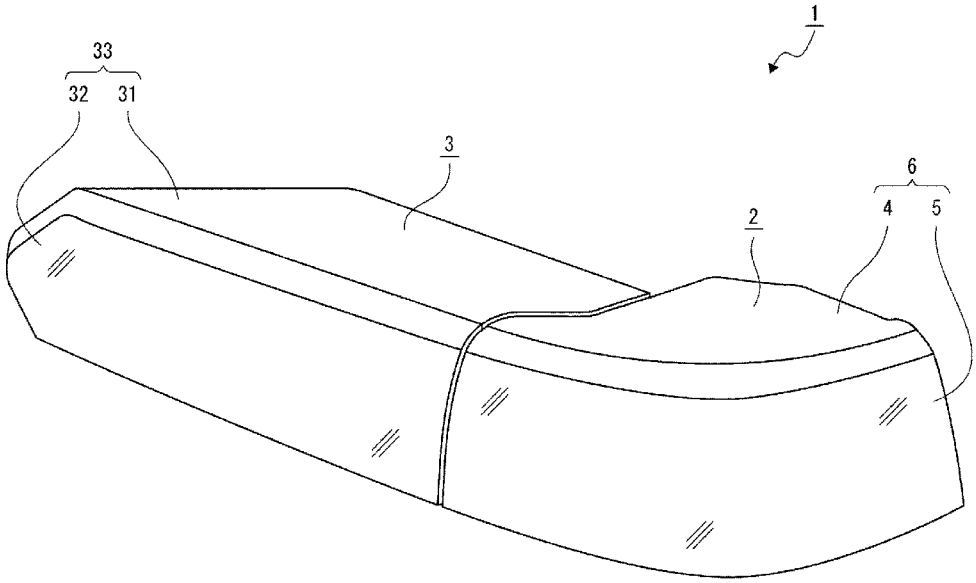
FIG. 2 is a perspective view illustrating the vehicle lamp.

The first lamp portion 2 includes a lamp housing 4 which is opened rearward and a cover 5 for blocking the opening of the lamp housing 4 (see FIG. 2). A lamp outer case 6 is constituted by the lamp housing 4 and the cover 5, and an interior space of the lamp outer case 6 is formed as a lamp chamber 6*a* (see FIG. 3).

Figure 3:
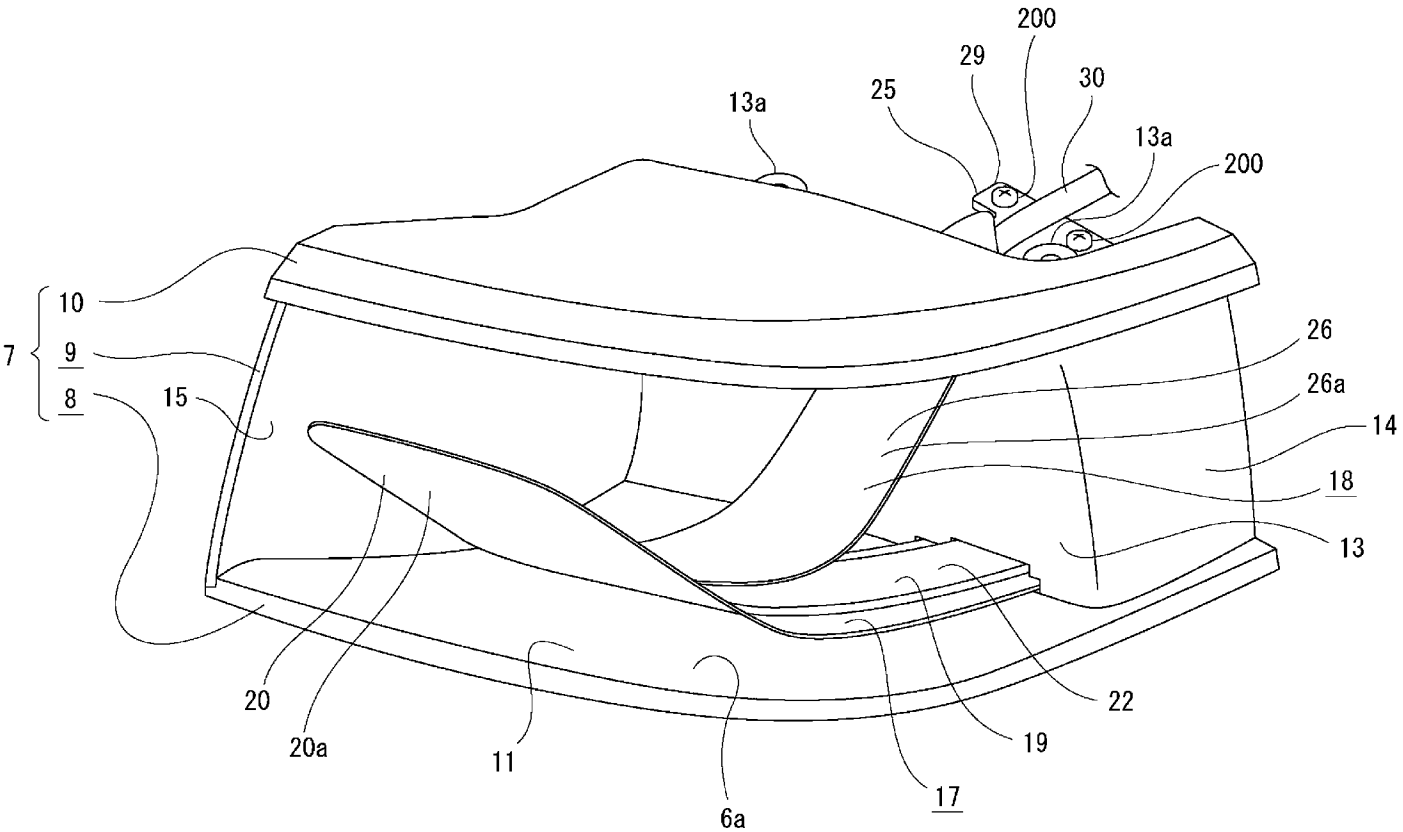
FIG. 3 illustrates a first lamp part together with FIGS. 4 to 9, and this figure is a perspective view of the first lamp part illustrating an internal structure thereof.
Figure 4:
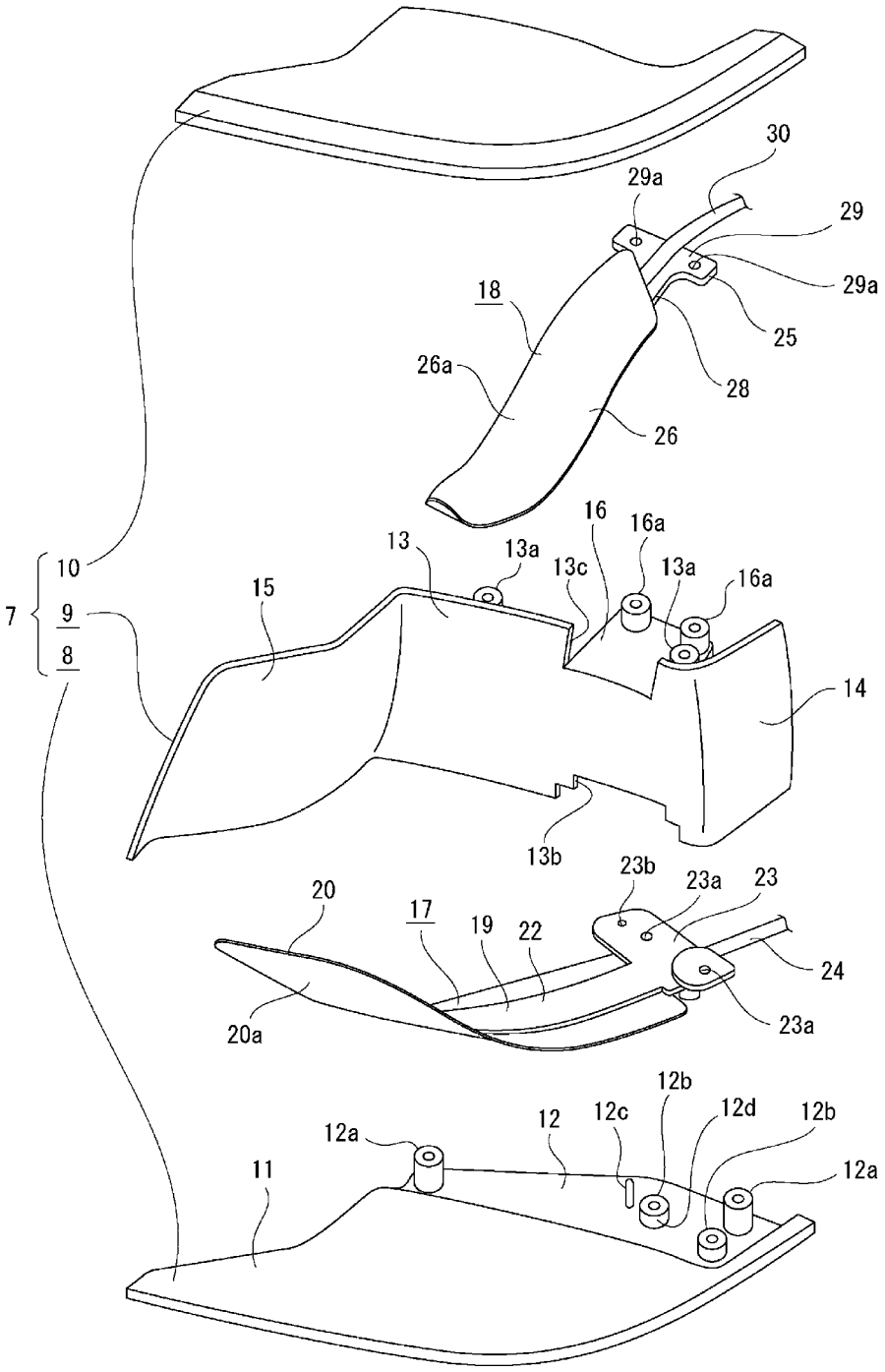
FIG. 4 is an exploded perspective view illustrating the internal structure of a first lamp part.
Figure 5:
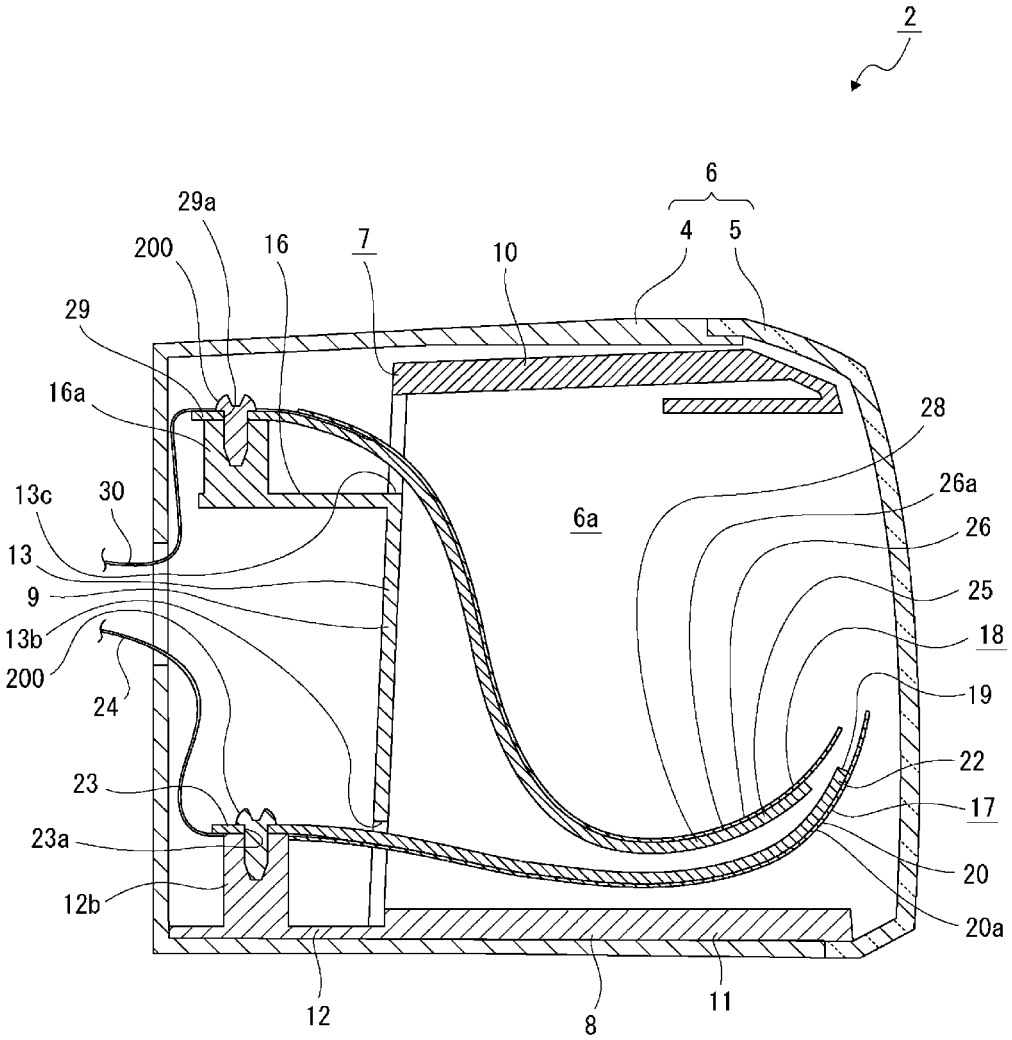
FIG. 5 illustrates a cross-sectional view of the first lamp part.

A first attachment body 7 is disposed in the lamp chamber 6*a*, and the first attachment body 7 is attached to, for example, the lamp housing 4 (see FIGS. 3 to 5). The first attachment body 7 also serves as an extension for shielding a part of a structure disposed in the lamp chamber 6*a*, and is configured by coupling a lower panel 8, a middle panel 9, and an upper panel 10.

The lower panel 8 includes a base surface portion 11 formed in a plate shape directed substantially toward the vertical direction and a coupling portion 12 continuous at a front edge of the base surface portion 11. Both left and right end portions of the coupling portion 12 are provided with coupling bosses 12*a* and 12*a* which protrude upward. In a position adjacent to one end of the coupling portion 12 in the left and right direction, first attaching portions 12*b* and 12*b* protruding upward are provided apart from each other in the left and right direction (see FIGS. 4 and 6). The first attaching portion 12*b* is formed, for example, substantially in a cylindrical shape of which an axial direction is the vertical direction. The coupling portion 12 is provided with a positioning pin 12*c* protruding upward in the vicinity of the first attaching portion 12*b*.

The middle panel 9 includes a shielding portion 13 positioned at the center in the left and right direction, side portions 14 and 15 continuous at the both left and right edges of the shielding portion 13 and respectively curved with respect to the shielding portion 13, and a bent portion 16 curved with respect to the shielding portion 13 (see FIGS. 3 and 4).

The shielding portion 13 is formed in a plate shape directed substantially toward a front and rear direction. An upper end portion of the shielding portion 13 is provided with coupling bosses 13*a* and 13*a*, respectively protruding upward, apart from each other in the left and right direction. In the shielding portion 13, a first insertion notch 13*b* which is opened downward is formed in a lower end portion of an end portion in the left and right direction.

The side portions 14 and 15 are formed in a plate shape directed substantially toward the left and right direction, respectively. The side portion 14 is positioned outside the vehicle with respect to the shielding portion 13 and is curved forward with respect to the shielding portion 13. The side portion 15 is positioned inside the vehicle with respect to the shielding portion 13 and is curved rearward with respect to the shielding portion 13.

The bent portion 16 is provided to be bent forward about 90 degrees from a position immediately above the first insertion notch 13*b* in the shielding portion 13. A rear end portion of the bent portion 16 is provided with second attaching portions 16*a* and 16*a*, respectively protruding upward, apart from each other in the left and right direction (see FIGS. 4 and 7). The second attaching portions 16*a* and 16*a* are formed substantially in a cylindrical shape of which an axial direction is, for example, the vertical direction.

At a portion where the bent portion 16 of the shielding portion 13 is bent, a space which is opened upward is formed, and this space is formed as a second insertion notch 13*c*. The second insertion notch 13*c* is positioned immediately above the first insertion notch 13*b*.

A lower end portion of the middle panel 9 is coupled to a front end portion of the base surface portion 11 of the lower panel 8 (see FIGS. 3 to 5). The coupling of the middle panel 9 to the lower panel 8 is performed by fixing respective parts of the middle panel 9 to the coupling bosses 12*a* and 12*a* by, for example, screwing.

In a state where the middle panel 9 is coupled to the lower panel 8, the coupling portion 12 of the lower panel 8 is positioned in the front side of the shielding portion 13. Accordingly, the coupling portion 12 is shielded from the rear by the shielding portion 13.

The upper panel 10 is formed in a plate shape directed substantially toward the vertical direction, and is formed in a shape and a size substantially the same as the shape and the size of the base surface portion 11 of the lower panel 8. A part of an outer circumferential portion of the upper panel 10 is coupled to respective upper end portions of the shielding portion 13 and the side portions 14 and 15 of the middle panel 9. The coupling of the upper panel 10 to the middle panel 9 is performed by fixing respective parts of the upper panel 10 to the coupling bosses 13*a* and 13*a* by, for example, screwing.

In the lamp chamber 6*a*, a first panel body 17 and a second panel body 18 are disposed in a state of being attached to the first attachment body 7, respectively.

Figure 8:
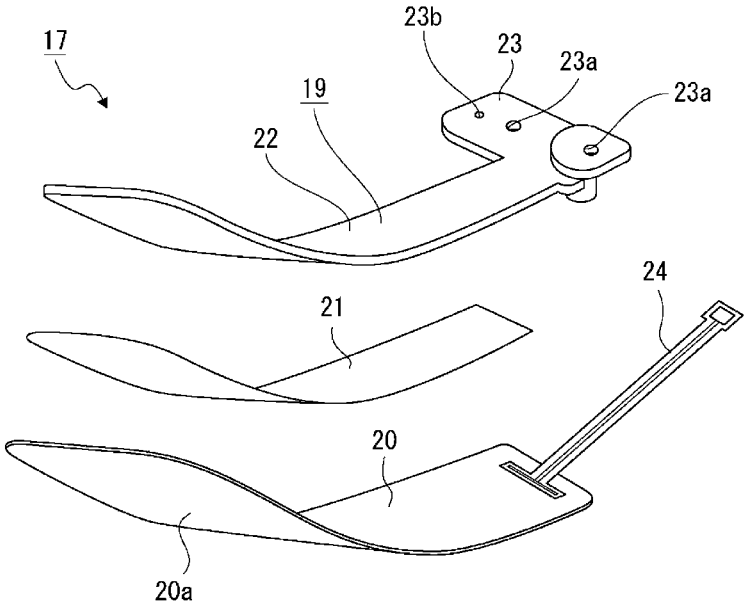
FIG. 8 is an exploded perspective view of the first panel body.

In the first panel body 17, a first organic electroluminescence (EL) panel 20 is attached to a first holding member 19 by, for example, a double-sided tape 21 (see FIG. 8). In the first holding member 19, a holding portion 22 in a curved shape and an attached portion 23 continuous at a front end of the holding portion 22 are formed integrally by, for example, a resin material. The holding portion 22 is curved convexly downward in a state where a rear end portion is positioned in an upper position relative to a front end portion. In the attached portion 23, screw insertion holes 23*a* and 23*a* spaced apart from each other in the left and right direction, and a positioning hole 23*b* are formed A part of the first organic EL panel 20 is attached to a lower surface of the holding portion 22 of the first holding member 19 by the double-sided tape 21 such that the rear end portion and both the left and right end portions of a portion other than the rear end portion protrude outwardly from the holding portion 22. A lower surface of the first organic EL panel 20 is formed as a light emitting surface 20*a*, and is curved convexly downward in a state where the rear end portion is in an upper position relative to a front end portion depending on a curved state of the holding portion 22. In addition, a part of an upper surface of the first organic EL panel 20 that protrudes outwardly from the holding portion 22 may also be formed as a light emitting surface.

A first connection line 24 is connected to the front end portion of the first organic EL panel 20, and the first connection line 24 is drawn to the front side from the first organic EL panel 20 through a lower side of the attached portion 23.

Figure 6:
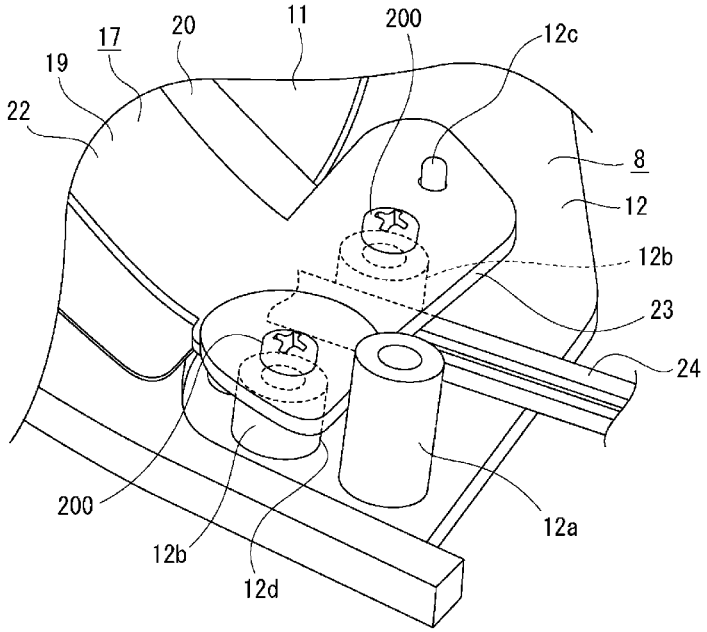
FIG. 6 is a perspective view illustrating an attachment structure of a first panel body.

In the first panel body 17, the attached portion 23 of the first holding member 19 is attached to the first attaching portions 12*b* and 12*b* of the lower panel 8 (see FIG. 6). The attached portion 23 is positioned with respect to the coupling portion 12 by inserting the positioning pin 12*c* into a positioning hole 23*b*, and is attached to the first attaching portions 12*b* and 12*b* by screwing attachment screws 200 and 200 inserted through the screw insertion holes 23*a* and 23*a* to the first attaching portions 12*b* and 12*b*, respectively.

A lower surface of the attached portion 23 is brought into surface contact with upper surfaces of the first attaching portions 12*b* and 12*b* in a state where the attached portion 23 is attached to the first attaching portions 12*b* and 12*b*. The first connection line 24 connected to the first organic EL panel 20 is inserted through between the first attaching portions 12*b* and 12*b* in a state where the attached portion 23 is attached to the first attaching portions 12*b* and 12*b*. Accordingly, a space between the first attaching portions 12*b* and 12*b* becomes an insertion space 12*d*. The first connection line 24 is connected to a power circuit (not illustrated), and light is emitted from the light emitting surface 20*a* by supplying a power from the power circuit to the first organic EL panel 20 through the first connection line 24.

As described above, the vehicle lamp 1 includes the two first attaching portions 12*b* and 12*b* which are spaced apart from each other, the space between the first attaching portions 12*b* and 12*b* is formed as the insertion space 12*d*, and the first connection line 24 connected to the first organic EL panel 20 to supply a power to the first organic EL panel 20 is inserted through the insertion space 12*d*.

Accordingly, since a part of the first connection line 24 that is connected to the first organic EL panel 20 is positioned between the first attaching portions 12*b* and 12*b*, the space for disposing the first connection line 24 is effectively utilized and the first connection line 24 is not easily displaced due to vibration of the vehicle. Further, it is difficult for the first connection line 24 to interfere with the first organic EL panel 20 or the first attachment body 7, and thus the first connection line 24 may be satisfactorily protected without affecting the disposition of components other than the first connection line 24.

In addition, since the attached portion 23 is positioned in an upper position relative to the first connection line 24, upward displacement of the first connection line 24 may be also suppressed, and accordingly, the first connection line 24 may be further satisfactorily protected.

In a state where the first organic EL panel 20 is attached to the first attaching portions 12*b* and 12*b*, a part of the first organic EL panel 20 in a rear position relative to the attached portion 23 passes through the first insertion notch 13*b* of the middle panel 9 and protrudes rearward, and the holding portion 22 of the first holding member 19 and the first organic EL panel 20 are positioned in a rear position relative to the shielding portion 13 (see FIGS. 3 and 5). Accordingly, the attached portion 23 and the first attaching portions 12*b* and 12*b* to which the attached portions 23 is attached are shielded from the rear side by the shielding portion 13. At this time, the holding portion 22 and the first organic EL panel 20 are disposed in the lamp chamber 6*a* in a state of floating upward from the lower panel 8, without contacting the lower panel 8.

As described above, the shielding portion 13 configured to shield the first attaching portions 12*b* and 12*b* and the attached portion 23 from the holding portion 22 is provided in the first attachment body 7.

Accordingly, since the first attaching portions 12*b* and 12*b* and the attached portion 23 are shielded by the shielding portion 13 and are not visually recognized, the light emitted from the first organic EL panel 20 may not be reflected by the first attaching portion 12*b* and 12*b* or the attached portion 23, thereby preventing generation of stray light and improving designability.

In addition, since the first organic EL panel 20 is disposed in a state of floating from the lower panel 8, it is possible to increase an area of a portion of the first organic EL panel 20 which becomes the light emitting surface 20*a*, thereby achieving improvement in luminance and the degree of freedom of light distribution.

As described above, the first panel body 17 is attached to the first attaching portions 12*b* and 12*b* in a cantilever state with the attached portion 23 positioned in the foremost position being attached to the first attaching portions 12*b* and 12*b*.

Figure 9:
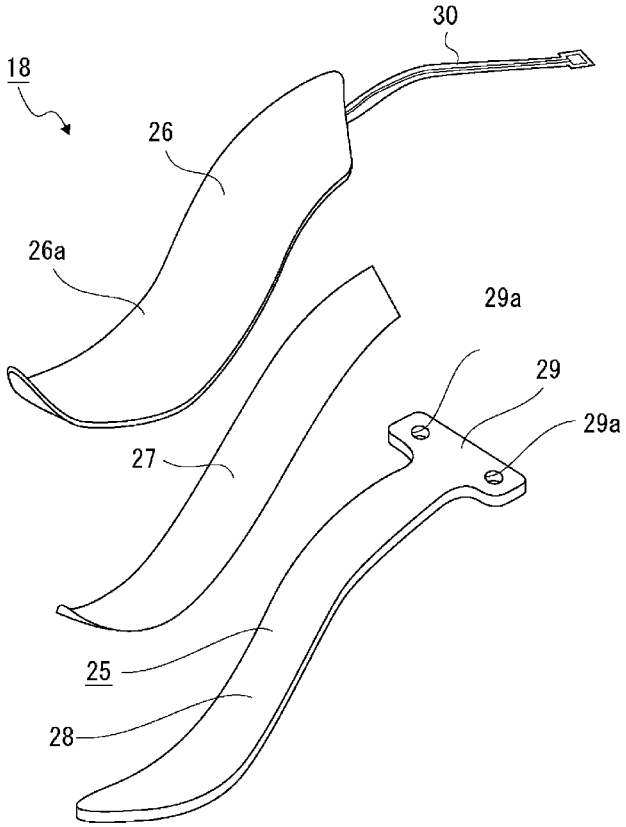
FIG. 9 is an exploded perspective view of the second panel body.

In the second panel body 18, a second organic electroluminescence (EL) panel 26 is attached to a second holding member 25 by, for example, a double-sided tape 27 (see FIG. 9). In the second holding member 25, a holding portion 28 in a curved shape and an attached portion 29 continuous at a front end of the holding portion 28 are formed integrally by, for example, a resin material. The holding portion 28 is curved in a state where a rear end portion is located in a lower position relative to a front end portion, a substantially half of the front side is curved convexly upward, and a substantially half of the rear side is curved convexly downward. Screw insertion holes 29*a* and 29*a* spaced apart from each other in the left and right direction are formed in the attached portion 29.

A part of the second organic EL panel 26 is attached to an upper surface of the holding portion 28 of the second holding member 25 by the double-sided tape 27 and a rear end portion and both left and right end portions of a portion other than the rear end portion protrude outwardly from the holding portion 28. An upper surface of the second organic EL panel 26 is formed as a light emitting surface 26*a*, and is curved in a state where the rear end portion is in a lower position relative to a front end portion depending on a curved state of the holding portion 28. In addition, a part of a lower surface of the second organic EL panel 26 that protrudes outwardly from the holding portion 28 may also be formed as a light emitting surface.

A second connection line 30 is connected to the front end portion of the second organic EL panel 26, and the second connection line 30 is drawn to the front side from the second organic EL panel 26 through an upper side of the attached portion 29.

Figure 7:
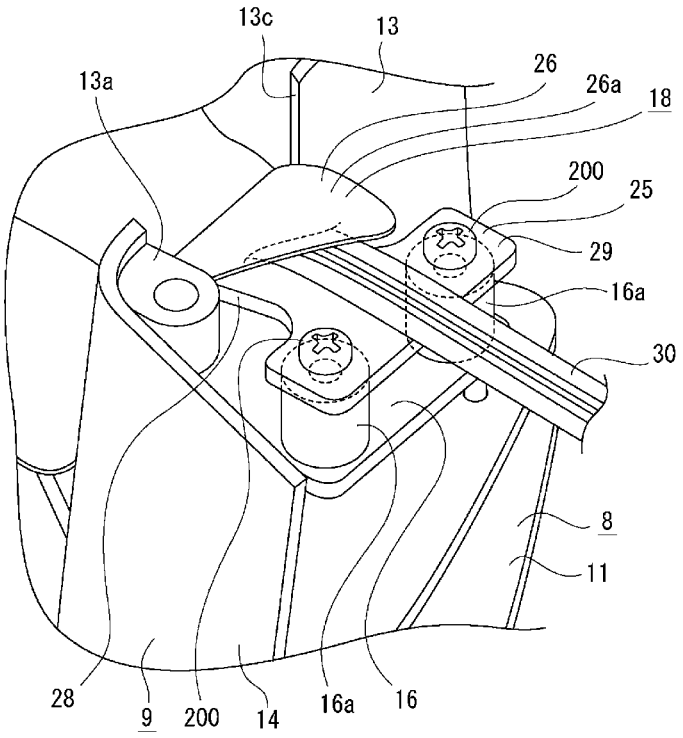
FIG. 7 is a perspective view illustrating an attachment structure of a second panel body.

In the second panel body 18, the attached portion 29 of the second holding member 25 is attached to the second attaching portions 16*a* and 16*a* of the middle panel 9 (see FIG. 7). The attached portion 29 is attached to the second attaching portions 16*a* and 16*a* by screwing the attachment screws 200 and 200 inserted through the screw insertion holes 29*a* and 29*a* to the second attaching portions 16*a* and 16*a*, respectively.

A lower surface of the attached portion 29 is brought into surface contact with upper surfaces of the second attaching portions 16*a* and 16*a* in a state where the attached portion 29 is attached to the second attaching portions 16*a* and 16*a*. The second connection line 30 connected to the second organic EL panel 26 is drawn to the front side from between the attachment screws 200 and 200, on the upper side of the attached portion 29 in a state where the attached portion 29 is attached to the second attaching portions 16*a* and 16*a*. The second connection line 30 is connected to a power circuit (not illustrated), and light is emitted from the light emitting surface 26*a* by supplying a power from the power circuit to the second organic EL panel 26 through the second connection line 30.

In a state that the second organic EL panel 26 is attached to the second attaching portions 16*a* and 16*a*, a part of the second organic EL panel 26 in a rear position relative to the attached portion 29 passes through the second insertion notch 13*c* of the middle panel 9 and protrudes rearward, and the holding portion 28 of the second holding member 25 and the second organic EL panel 26 are located in a rear position relative to the shielding portion 13 (see FIGS. 3 and 5). Accordingly, the attached portion 29 and the second attaching portions 16*a* and 16*a* to which the attached portion 29 is attached are shielded from the rear side by the shielding portion 13. At this time, the holding portion 28 and the second organic EL panel 26 are disposed in the lamp chamber 6*a*, above the first panel body 17, in a state of floating upward from the lower panel 8, without contacting the lower panel 8.

As described above, the shielding portion 13 configured to shield the second attaching portions 16*a* and 16*a* and the attached portion 29 from the holding portion 28 is provided in the first attachment body 7.

Accordingly, since the second attaching portions 16*a* and 16*a* and the attached portion 29 are shielded by the shielding portion 13 and are not visually recognized, the light emitted from the second organic EL panel 26 may not be reflected by the second attaching portions 16*a* and 16*a* or the attached portion 29, thereby preventing generation of stray light and improving designability.

In addition, since the second organic EL panel 26 is disposed in a state of floating from the lower panel 8, it is possible to increase an area of a portion of the second organic EL panel 26 which becomes the light emitting surface 26*a*, thereby achieving improvement in luminance and the degree of freedom of light distribution control.

In addition, since the first organic EL panel 20 and the second organic EL panel 26 are held in the holding portions 22 and 28, respectively, in a curved state in a thickness direction, light may be emitted from the first organic EL panel 20 and the second organic EL panel 26 that are curved, thereby achieving improvement in the degree of freedom of light distribution control.

In addition, since at least a part of each of the first organic EL panel 20 and the second organic EL panel 26 is curved in a downward convex state, there is a portion displaced upwardly toward the rear side, and it is possible to secure a sufficient viewing angle in an upward direction, and thus further improvement in the degree of freedom of light distribution control may be achieved.

<Configuration of Second Lamp Portion>

The second lamp portion 3 includes a lamp housing 31 opened rearward and a cover 32 for blocking the opening of the lamp housing 31 (see FIG. 2). A lamp outer case 33 is constituted by the lamp housing 31 and the cover 32, and an interior space of the lamp outer case 33 is formed as a lamp chamber 33*a* (see FIG. 10).

Figure 10:
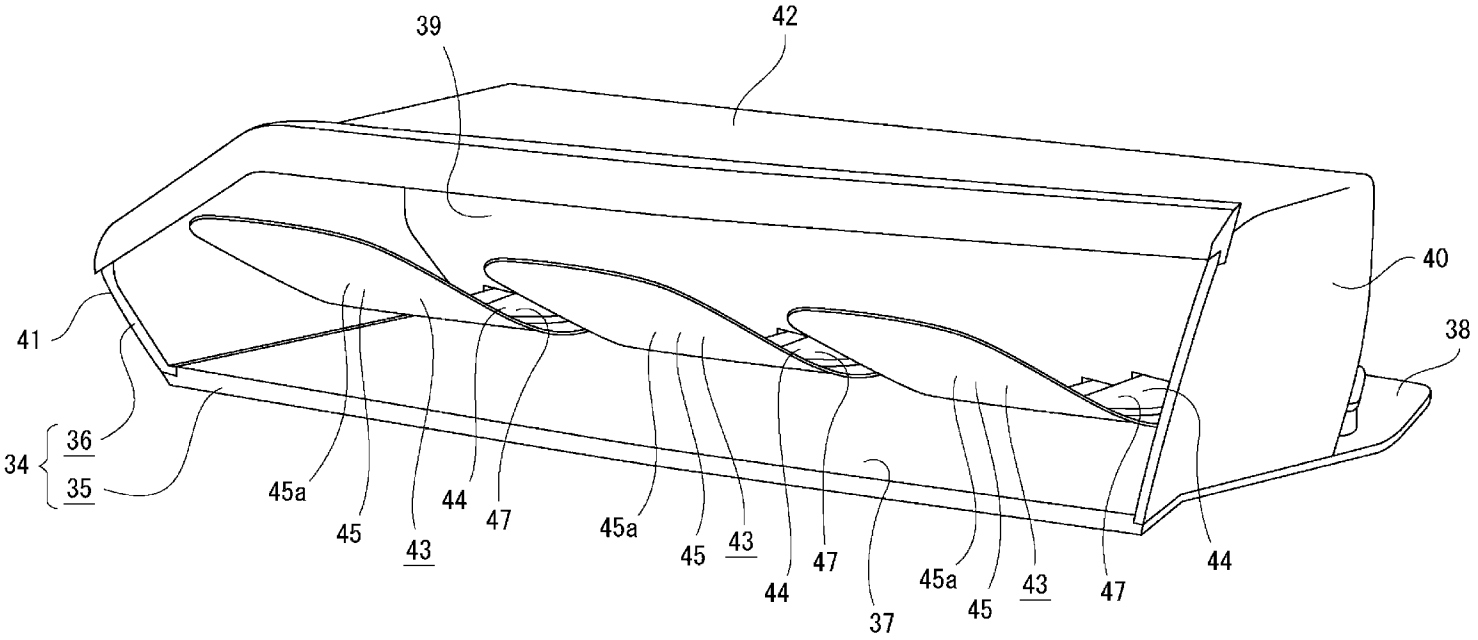
FIG. 10 illustrates a second lamp part together with FIGS. 11 to 14, and this figure is a perspective view illustrating an internal structure of the second lamp part.
Figure 11:
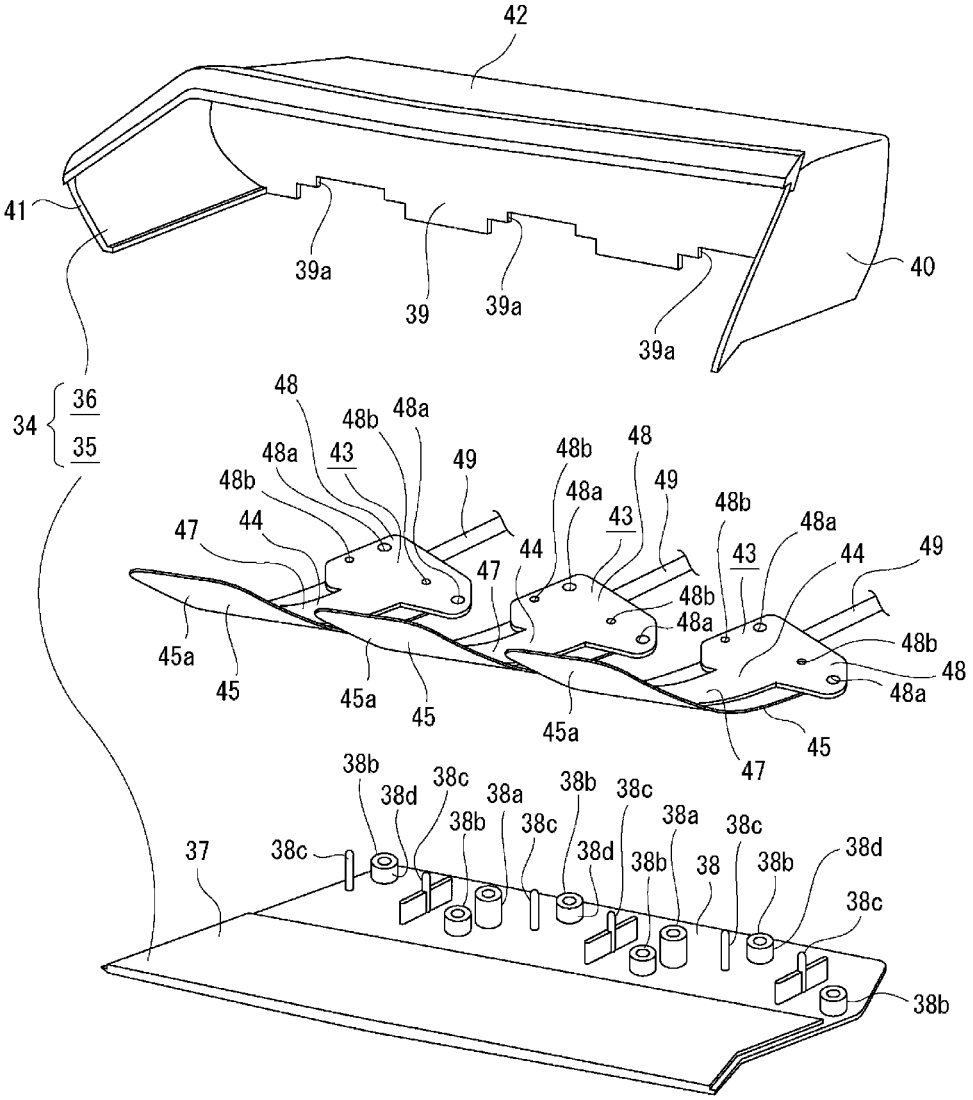
FIG. 11 is an exploded perspective view illustrating the internal structure of a second lamp part.
Figure 12:
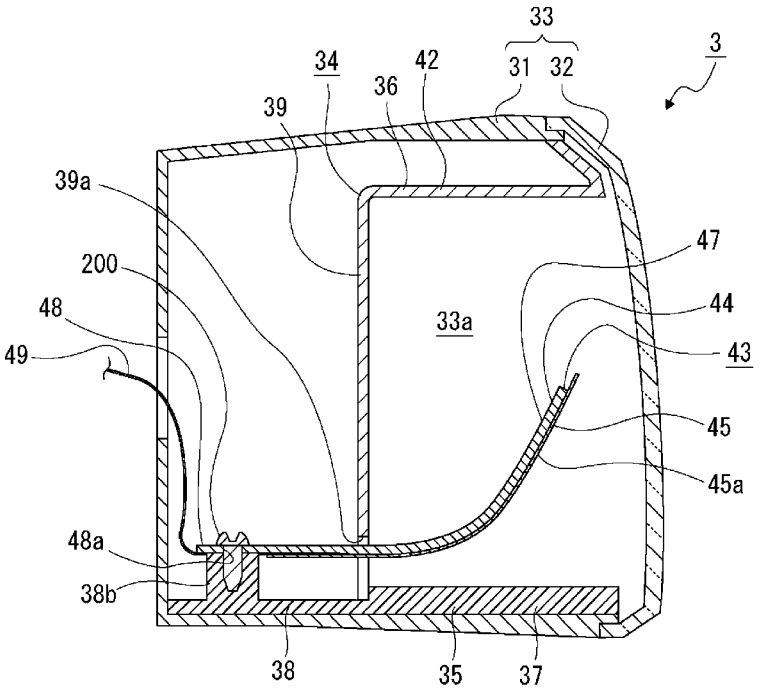
FIG. 12 is a cross-sectional view of a second lamp part.

A second attachment body 34 is disposed in the lamp chamber 33*a*, and the second attachment body 34 is attached to, for example, the lamp housing 31 (see FIGS. 10 to 12). The second attachment body 34 also serves as an extension for shielding a part of a structure disposed in the lamp chamber 33*a*, and is configured by coupling a lower panel 35 and a cover panel 36.

The lower panel 35 includes a base surface portion 37 in a plate shape directed substantially toward the vertical direction and a coupling portion 38 continuous at a front edge of the base surface portion 37. The coupling portion 38 is provided with coupling bosses 38*a* and 38*a* which protrude upward. The coupling portion 38 is provided with two attaching portions 38*b*, 38*b*, . . . which respectively protrude upward apart from each other in the left and right direction on each of the left and right sides of the coupling bosses 38*a* and 38*a* (see FIGS. 11 and 13). The second attaching portion 38*b* is formed, for example, substantially in a cylindrical shape of which an axial direction is the vertical direction. The coupling portion 38 is provided with positioning pins 38*c*, 38*c*, . . . protruding upward in the vicinity of the second attaching portions 38*b*, 38*b*, . . . .

The cover panel 36 includes a shielding portion 39 directed in the front and rear direction, side portions 40 and 41 continuous at both left and right edges of the shielding portion 39, and a cover portion 42 directed in the vertical direction (see FIGS. 10 and 11).

At a lower end portion of the shielding portion 39, insertion notches 39*a*, 39*a*, and 39*a* which are opened downward are formed apart from each other in the left and right direction. A side portion 40 is positioned outside the vehicle with respect to the shielding portion 39, and a side portion 41 is positioned inside the vehicle with respect to the shielding portion 39. An outer circumferential portion of the cover portion 42 is continuous at an upper end portion of the shielding portion 39 and upper end portions of the side portions 40 and 41.

A lower end portion of the cover panel 36 is coupled to an outer circumferential portion of the base surface portion 37 of the lower panel 35 (see FIGS. 10 to 12). The coupling of the cover panel 36 to the lower panel 35 is performed by fixing respective parts of the cover panel 36 to the coupling bosses 38*a* and 38*a* by, for example, screwing.

The coupling portion 38 of the lower panel 35 is located in the front side of the shielding portion 39. Accordingly, the coupling portion 38 is shielded from the rear side by the shielding portion 39.

In the lamp chamber 33*a*, panel bodies 43, 43, and 43 are disposed, each in a state of being attached to the second attachment body 34.

Figure 14:
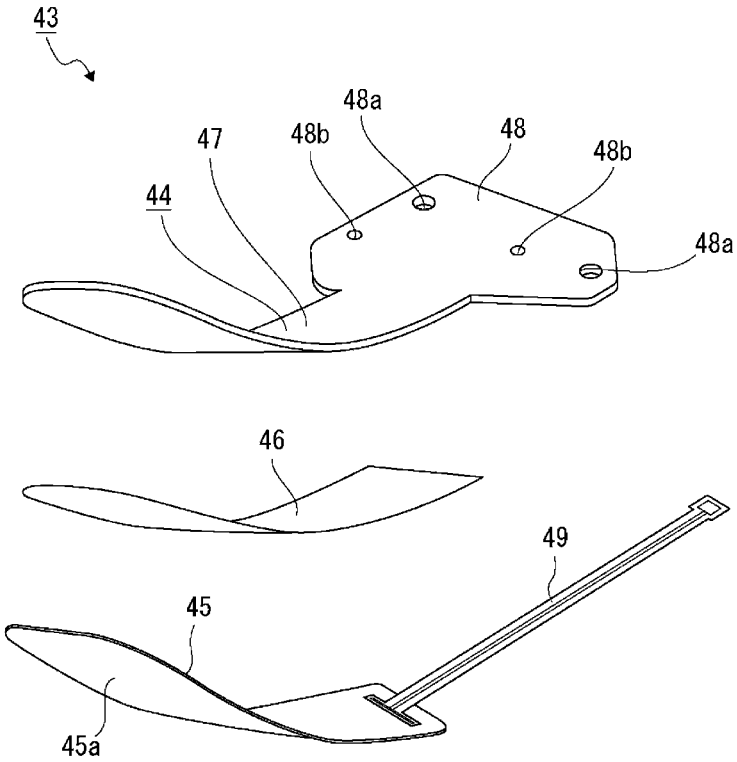
FIG. 14 is an exploded perspective view of a panel body.

In the panel body 43, an organic electroluminescence (EL) panel 45 is attached to a holding member 44 by, for example, a double-sided tape 46 (see FIG. 14). In the holding member 44, a holding portion 47 in a curved shape and an attached portion 48 continuous at a front end of the holding portion 47 are formed integrally by, for example, a resin material. The holding portion 47 is curved convexly downward in a state where a rear end portion is located in an upper position relative to a front end portion. In the attached portion 48, screw insertion holes 48*a* and 48*a* spaced apart from each other in the left and right direction, and a positioning hole 48*b* are formed A part of the organic EL panel 45 is attached to a lower surface of the holding portion 47 of the holding member 44 by the double-sided tape 46 and a rear end portion and both left and right end portions of a portion other than the rear end portion protrude outwardly of the holding portion 47. A lower surface of the organic EL panel 45 is formed as a light emitting surface 45*a* and the organic EL panel 45 is curved convexly downward in a state where the rear end portion is in an upper position relative to a front end portion depending on a curved state of the holding portion 47. In addition, a part of an upper surface of the organic EL panel 45 that protrudes outwardly from the holding portion 47 may also be formed as a light emitting surface.

A connection line 49 is connected to the front end portion of the organic EL panel 45, and the connection line 49 is drawn to the front side from the organic EL panel 45 through a lower side of the attached portion 48.

Figure 13:
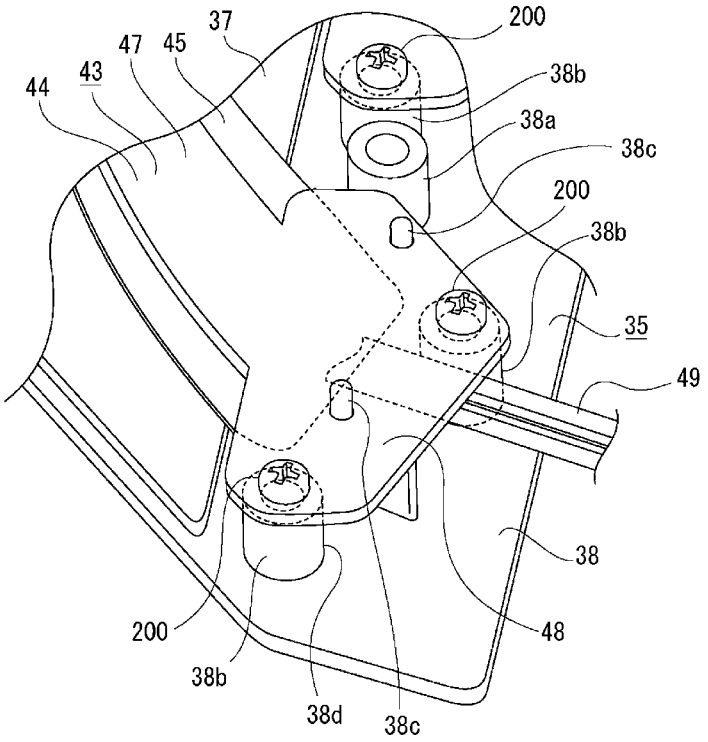
FIG. 13 is a perspective view illustrating an attachment structure of a panel body.

In the panel body 43, the attached portion 48 of the holding member 44 is attached to the attaching portions 38*b* and 38*b* of the lower panel 35 (see FIG. 13). The attached portion 48 is positioned with respect to the coupling portion 38 by inserting the positioning pin 38*c* into positioning holes 48*b*, and the attached portion 48 is attached to the attaching portions 38*b* and 38*b* by screwing the attachment screws 200 and 200 inserted through the screw insertion holes 48*a* and 48*a* to the attaching portions 38*b* and 38*b*, respectively.

A lower surface of the attached portion 48 is brought into surface contact with upper surfaces of the attaching portions 38*b* and 38*b* in a state where the attached portion 48 is attached to the attaching portions 38*b* and 38*b*. The connection line 49 connected to the organic EL panel 45 is inserted through between the attaching portions 38*b* and 38*b* in a state where the attached portion 48 is attached to the attaching portions 38*b* and 38*b*. Accordingly, a space between the attaching portions 38*b* and 38*b* becomes an insertion space 38*d*. The connection line 49 is connected to a power circuit (not illustrated), and light is emitted from the light emitting surface 45*a* by supplying a power from the power circuit to the organic EL panel 45 through the connection line 49.

As described above, in the vehicle lamp 1, the two attaching portions 38*b* and 38*b* spaced apart from each other are provided, the space between the attaching portions 38*b* and 38*b* is formed as the insertion space 38*d*, and the connection line 49 connected to the organic EL panel 45 to supply a power to the organic EL panel 45 is inserted through the insertion space 38*d*.

Accordingly, since a part of the connection line 49 that is connected to the organic EL panel 45 is positioned between the attaching portions 38*b* and 38*b*, the space for disposing the connection line 49 is effectively utilized and the connection line 49 is not easily displaced due to vibration of the vehicle. Further, it is difficult for the connection line 49 to interfere with the organic EL panel 45 or the second attachment body 34, and thus the connection line 49 may be satisfactorily protected without affecting the disposition of components other than the connection line 49.

In addition, since the attached portion 48 is in an upper position relative to the connection line 49, upward displacement of the connection line 49 may be also suppressed, and accordingly, the connection line 49 may be further satisfactorily protected.

In a state where the organic EL panels 45, 45, and 45 are attached to the attaching portions 38*b*, 38*b*, . . . , parts of the organic EL panels 45, 45, and 45 in a rear position relative to the attached portions 48, 48, and 48 pass through the insertion notches 39*a*, 39*a*, and 39*a* of the cover panel 36 and protrude rearward, and the holding portions 47, 47, and 47 of the holding members 44, 44, and 44 and the organic EL panels 45, 45, and 45 are positioned in a rear position relative to the shielding portion 39 (see FIGS. 10 and 12). Accordingly, the attached portions 48, 48, and 48 and the attaching portions 38*b*, 38*b*, . . . to which the attached portions 48, 48, and 48 are attached are shielded from the rear side by the shielding portion 39. At this time, the holding portions 47, 47, and 47 and the organic EL panels 45, 45, and 45 are disposed in the lamp chamber 33*a* in a state of floating upward from the lower panel 35, without contacting the lower panel 35.

As described above, the panel body 43 is attached to the attaching portion 38*b*, 38*b*, . . . in a cantilever state with the attached portion 48 positioned in the foremost position being attached to the attaching portions 38*b* and 38*b*.

As described above, the second attachment body 34 is provided with the shielding portion 39 configured to shield the second attaching portions 38*b* and 38*b* and the attached portion 48 from the holding portion 47.

Accordingly, since the second attaching portions 38*b* and 38*b* and the attached portion 48 are shielded by the shielding portion 39 and are not visually recognized, the light emitted from the organic EL panel 45 may not be reflected by the second attaching portions 38*b* and 38*b* or the attached portion 48, thereby preventing generation of stray light and improving designability.

In addition, since the organic EL panel 45 is disposed in a state of floating from the lower panel 35, it is possible to increase an area of a portion of the organic EL panel 45 that becomes the light emitting surface 45*a*, thereby achieving improvement in luminance and the degree of freedom of light distribution control.

In addition, since the organic EL panel 45 is held in a curved state in a thickness direction by the holding portion 47, light may be emitted from the organic EL panel 45 that is curved, thereby achieving improvement in the degree of freedom of light distribution control.

In addition, since at least a part of the organic EL panel 45 is curved in a downward convex state, there is a portion displaced upwardly toward the rear side, and it is possible to secure a sufficient viewing angle in an upward direction, and thus, further improvement in the degree of freedom of light distribution control may be achieved.

SUMMARY

As described above, in the vehicle lamp 1, the first attachment body 7 and the second attachment body 34 are provided with the first attaching portion 12*b*, the second attaching portion 16*a*, and the attaching portion 38*b* to which the attached portions 23, 29, and 48 are attached, and the first panel body 17, the second panel body 18, and the panel body 43 are attached to the first attachment body 7 and the second attachment body 34 in a cantilever state.

Accordingly, since the first panel body 17, the second panel body 18, and the panel body 43 are attached to the first attachment body 7 and the second attachment body 34 in a cantilever state, a size of an occupied space of the first attaching portion 12*b*, the second attaching portion 16*a*, and the attaching portion 38*b* in the lamp chambers 6*a* and 33*a* may become relatively small. In addition, it is difficult for the light emitted from the first organic EL panel 20, the second organic EL panel 26, and the organic EL panel 45 to be reflected by the first attaching portion 12*b*, the second attaching portion 16*a*, and the attaching portion 38*b*, and thus an appropriate light distribution state may be secured and miniaturization may be achieved.

In addition, although the example in which the single first panel body 17 and the single second panel body 18 are provided in the first lamp portion 2, and the three panel bodies 43 are provided in the second lamp portion 3 has been described above, the number of each of the first panel body 17, the second panel body 18, and the panel body 43 is not limited to one or three, and is arbitrary.

In addition, the first panel body 17, the second panel body 18, and the panel body 43 may not be curved, or may be curved to have an upward convex portion or a lateral convex portion.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle lamp comprising:

a lamp outer case including a lamp housing having an opening and a cover configured to block the opening, an interior space of the lamp outer case being formed as a lamp chamber;

a panel body including a holder disposed in the lamp chamber and provided with an attached portion and a holding portion, and an organic electroluminescence panel held in the holding portion; and an attachment body disposed in the lamp chamber and attached with the panel body, wherein the attachment body includes:

an attaching portion to which the attached portion is attached; and a shielding portion configured to shield the attaching portion and the attached portion from the holding portion from the holding portion, and wherein the panel body is attached to the attachment body in a cantilever state.

2. The vehicle lamp according to claim 1, wherein the organic electroluminescence panel is connected with a connection line configured to supply a power, two attaching portions are provided apart from each other, a space between the two attaching portions is formed as an insertion space, and the connection line is inserted through the insertion space.

3. The vehicle lamp according to claim 1, wherein the organic electroluminescence panel is held in the holding portion in a state of being curved in a thickness direction.

4. The vehicle lamp according to claim 3, wherein at least a part of the organic electroluminescence panel is curved in a downward convex state.

5. A vehicle lamp comprising:

a lamp outer case including a lamp housing having an opening and a cover configured to block the opening, an interior space of the lamp outer case being formed as a lamp chamber;

a panel body including a holder disposed in the lamp chamber and provided with an attached portion and a holding portion, and an organic electroluminescence panel held in the holding portion; and an attachment body disposed in the lamp chamber and attached with the panel body, wherein the attachment body includes an attaching portion to which the attached portion is attached, the panel body is attached to the attachment body in a cantilever state, the organic electroluminescence panel is connected with a connection line configured to supply a power, two attaching portions are provided apart from each other, a space between the two attaching portions is formed as an insertion space, and the connection line is inserted through the insertion space.

* * * * *